US005393110A

United States Patent [19]

Nakamori et al.

[11] Patent Number: 5,393,110

[45] Date of Patent: Feb. 28, 1995

[54] COVER OPENING/CLOSING DEVICE

[75] Inventors: Hiroshi Nakamori; Kazunori Kono, both of Hirakata, Japan

[73] Assignee: Matsushita Electric Industrial Co., Ltd., Osaka, Japan

[21] Appl. No.: 34,889

[22] Filed: Mar. 19, 1993

[30] Foreign Application Priority Data

Mar. 25, 1992 [JP] Japan ..... 4-066788

[51] Int. Cl.[6] ..... E05C 3/16

[52] U.S. Cl. ..... 292/216; 292/228

[58] Field of Search ..... 292/106, 128, 216, 228, 292/207; 220/729, 732; 206/387, 591

[56] References Cited

U.S. PATENT DOCUMENTS

| | | | |
|---|---|---|---|
| 1,257,051 | 2/1918 | Thomas | 292/128 |
| 2,399,302 | 4/1946 | Thiele | 292/106 X |
| 2,712,464 | 7/1955 | Collar et al. | 292/128 |
| 2,894,379 | 7/1959 | Saunders | 292/128 X |
| 3,197,246 | 7/1965 | Russell et al. | 292/128 X |
| 3,626,730 | 12/1971 | Murase | 292/106 X |
| 3,730,334 | 5/1973 | Tsuji | 206/387 |
| 3,979,144 | 9/1976 | Bascou | 292/216 |
| 4,927,194 | 5/1990 | Wagner | 292/128 |
| 5,174,617 | 12/1992 | Huber et al. | 292/106 X |

FOREIGN PATENT DOCUMENTS

| | | | |
|---|---|---|---|
| 638705 | 3/1962 | Canada | 292/228 |
| 149645 | 12/1931 | Switzerland | 292/128 |

*Primary Examiner*—Peter M. Cuomo
*Assistant Examiner*—Jerry Redman
*Attorney, Agent, or Firm*—Stevens, Davis, Miller & Mosher

[57] ABSTRACT

A cover opening/closing device prevents backlash when the cover is closed, by engaging the cover with a lock cam and urging the lock cam to be rotated into positions by a toggle spring. For this object, this device comprises a lock cam which is rotated about a rotational shaft provided in a main body, an operation lever which rotates the lock cam to open the cover, and a toggle spring which is designed to maintain the lock cam in urged states at the respective cover-opened and cover-closed positions. The lock cam can be kept urged in the cover-closed state.

12 Claims, 6 Drawing Sheets

COVER OPENING/CLOSING DEVICE

BACKGROUND OF THE INVENTION

1. Industrial Field of the Invention

The present invention relates to a cover opening/-closing device in an apparatus having a cover which is opened/closed when rotated about a rotational shaft provided in a main body, e.g., a cassette cover of a cassette tape recorder or the like.

2. Description of the Prior Art

Recently, various kinds of devices have been suggested as a cover opening/closing device in an apparatus with a cover which is opened/closed when rotated about a rotational shaft provided in a main body, such as a cassette cover of a cassette tape recorder or the like. One example of the conventional cover opening/closing device will now be described with reference to the attached drawings.

FIG. 11 is a front view showing one example of a cover opening/closing device in a conventional cassette tape recorder, and FIG. 12 is a cross-sectional view of the same in the cover-closed state. Referring to these figures, a cover 31 serving as a cassette envelope is designed to open and close a main body 32, and an engaging piece 33 for closing the cover is attached on a free-end portion of the cover 31. A chassis 34 is provided in the main body 32. A cover opening lever 35 is integrally formed with an engaging claw 36. An open knob 35*a* is formed on the cover opening lever 35. A spring 37 for returning the cover opening lever 35 is interposed in such a manner that one end of the return spring 37 abuts against the cover opening lever 35, and that the other end abuts against the chassis 34. In the illustration, reference numeral 38 denotes a tape cassette received in a receiving portion on a mechanism chassis 39 which is provided inside of the main body 32.

With such a structure, in order to open the cover, the cover opening lever 35 is operated in the compression direction (indicated by the arrow in the illustration) against the urging force of the return spring 37, to thereby release the engaging claw 36 from the engagement with the engaging piece 33 of the cover 31. Thus, the cover is opened by the urging force (not shown) in the cover opening direction which is applied to the cover 31, or by manual operation. On the other hand, in order to close the cover, the cover 31 in the open state is pressed and urged toward the main body 32, so as to bring the engaging piece 33 into contact with the engaging claw 36 of the cover opening lever 35. By further pressing and urging the cover 31, the cover opening lever 35 is operated in the compression direction of the return spring 37. When the engaging piece 33 reaches the position where it is engaged with the engaging claw 36, as shown in FIG. 11, the cover opening lever 35 is engaged by the return force of the return spring 37.

In the conventional cover opening/closing device described above, a gap a is defined between the cover 31 and the main body 32 so that return of the return spring 37 will not be interrupted, in order to surely hold the position of the cover opening lever 35 at the time of cover closing operation. However, the gap a cannot be kept constant due to deviations of the finished dimensions of component parts and so forth, thereby deteriorating the quality as a product. Further, deviations in the gap a, the thickness of the tape cassette 38 received in the main body and so forth result in another problem that the tape cassette 38 may freely move inside of the main body, as indicated by dotted lines in FIG. 12, and cannot be held therein stably.

Taking the problems of the conventional technique into consideration, this invention has been achieved to attain an object to provide a cover opening/closing device which minimizes backlash between the cover and the main body when the cover is closed, and which enables an article to be received between the cover and the main body stably.

SUMMARY OF THE INVENTION

In order to solve the above-described problems, the present invention provides a cover opening/closing device for opening/closing a cover by rotating it about a rotational shaft provided in a main body, comprising a lock cam rotatably supported on a chassis which constitutes the main body, the lock cam including an engaging claw to be engaged with an engaging piece provided on the cover, an operation lever which can rotate the lock cam, and a toggle spring for urging the lock cam to rotate into two urged states, i.e., a first urged state in which the engaging claw of the lock cam is engaged with the engaging piece and a second urged state in which it is released from the engagement, the operation lever being designed to rotate the lock cam in the engaged condition at least to such a position that the lock cam can be released from the engagement with the engaging piece of the cover.

With the cover opening/closing device of this invention having such a structure, when the cover in the open state is closed, the engaging piece of the cover is brought into contact with a pressing portion of the lock cam, and when the cover is further closed, the lock cam is rotated about the rotational shaft, and it is urged by the toggle spring just before it reaches the cover-closed state, so that the cover can be closed without operating the operation lever. Further, by operating the operation lever, the lock cam is rotated to open the cover, and it is maintained in the first urged state by the toggle spring. In consequence, the cover will not be closed even if the user releases his hand from the operating portion of the operation lever.

DETAILED DESCRIPTION OF THE PREFERRED EMBODIMENTS

The preferred embodiments of cover opening/closing devices according to the present invention will be hereinafter described in detail with reference to FIGS. 1 to 10.

Figure 1:
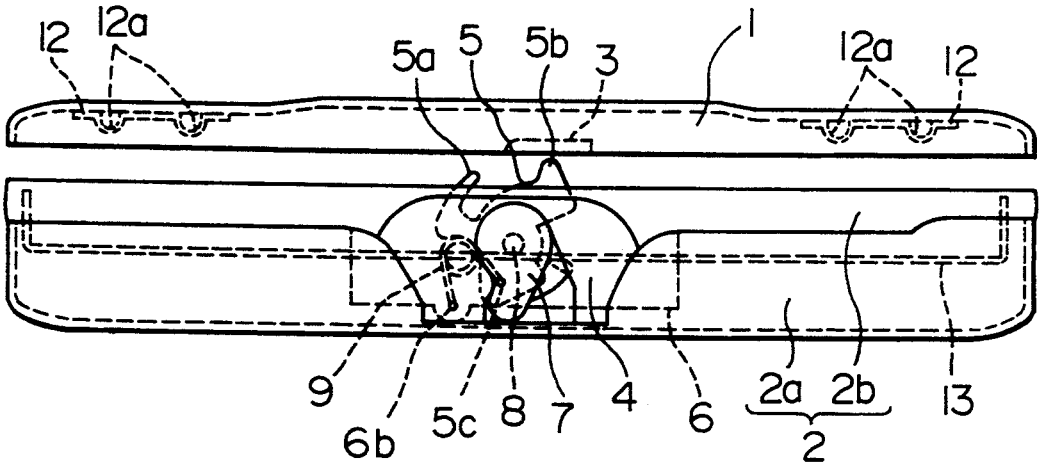
FIGS. 1 is a front view showing a cover opening/-closing device in the cover-opened state in a first embodiment according to the present invention.
Figure 2:
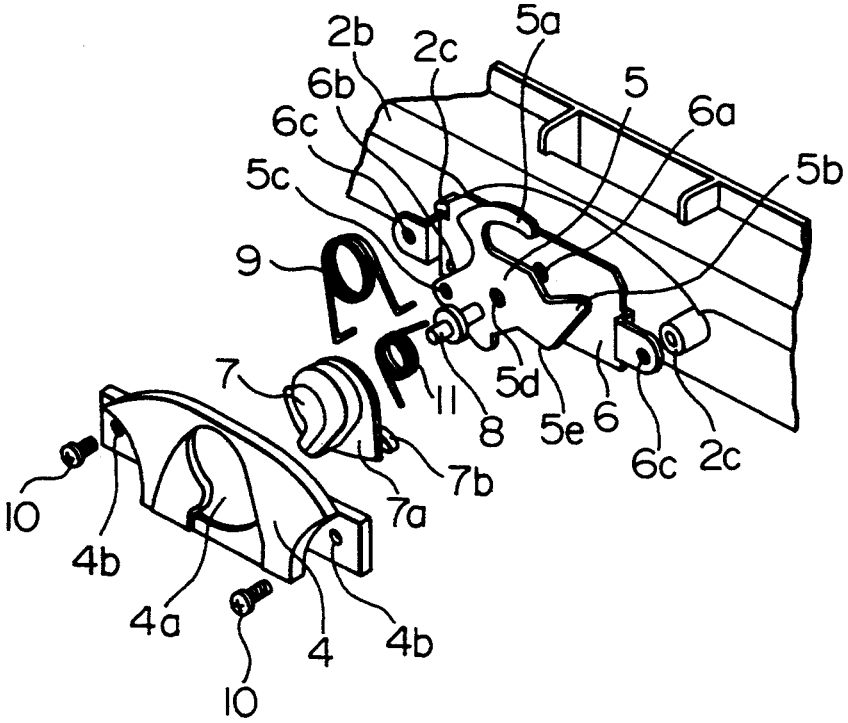
FIG. 2 is an exploded perspective view of a lock cam portion of the device in FIG. 1.
Figure 3:
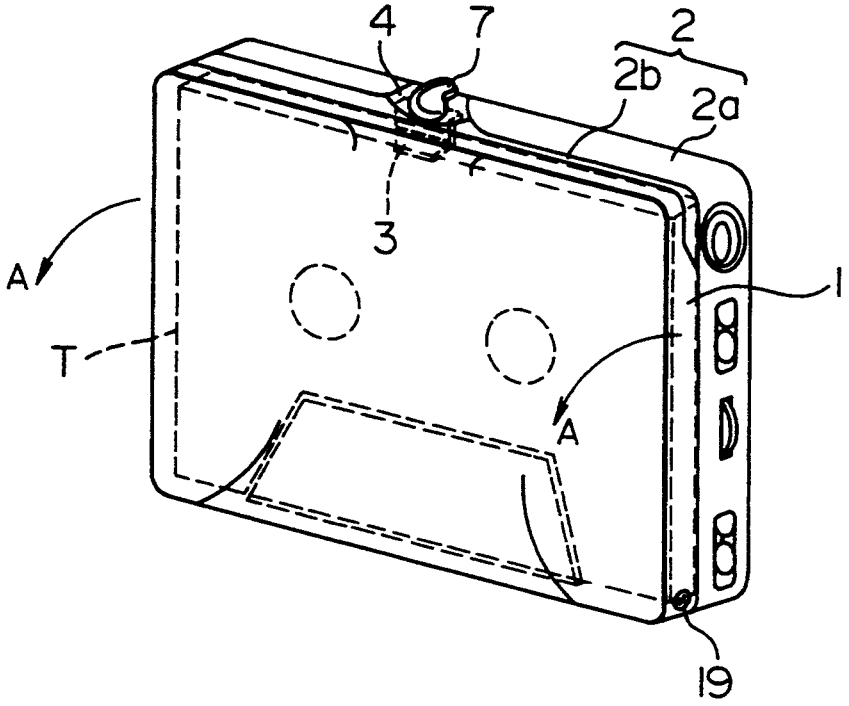
FIG. 3 is a perspective view of a whole cassette tape recorder in which the device according to the invention is used.

FIG. 1 is a front view of a first embodiment in which a cover opening/closing device according to this invention is used, showing the structure of a cassette tape recorder in a cover-opened state, FIG. 2 is an exploded perspective view of a lock cam portion of the device, and FIG. 3 is a perspective view of the whole cassette tape recorder.

Referring to FIGS. 1 and 2, a cover 1 serving as a cassette envelope is attached to a tape recorder body 2 in a manner to be opened and closed freely. An engaging piece 3 is provided on a free-end central portion of the cover 1. The body 2 comprises a main cabinet 2*a* and an intermediate cabinet 2*b* which constitutes one part of the body 2 with the main cabinet 2*a* and which also serves as a chassis. An ornament lug 4 and a lock cam support plate 6 for rotatably supporting a lock cam 5 are attached to the intermediate cabinet 2*b*. A rotational shaft 8 is inserted in a shaft hole 6*a* of the lock cam support plate 6 and fixed thereto so as to be formed integrally with the lock cam support plate 6, and the lock cam 5 is rotatably supported on the rotational shaft 8 through a shaft hole 5*d*. Also, an operation lever 7 is rotatably supported on the rotational shaft 8. The operation lever 7 is further closely fitted in a center opening 4*a* of the ornament lug 4, and serves to rotate the lock cam 5 when the cover 1 is opened.

The lock cam 5 includes an engaging claw 5*a* to be engaged with the engaging piece 3 of the cover 1, and a pressing portion 5*b* to be projected toward the engaging piece 3 of the cover 1 in the open state of the cover 1 (the state shown in FIG. 1). Further, the lock cam 5 includes a spring-force application portion 5*c* to which a spring force is applied, and this spring-force application portion 5*c* is located on the opposite side to the pressing portion 5*b* centered on the rotational shaft 8. A toggle spring 9 is provided between the spring-force application portion 5*c* and a portion 6*b* of the lock cam support plate 6 where the spring end is fixed. The lock cam support plate 6 is provided with attaching holes 6*c* corresponding to bosses 2*c* formed on the intermediate cabinet 2*b*. Similar attaching holes 4*b* are formed in the ornament lug 4 so that the lock cam support plate 6 and the ornament lug 4 can be attached to the intermediate cabinet 2*b* by screw-fasteners 10. The operation lever 7 includes a flat plate portion 7*a* which closes the center opening 4*a* of the ornament lug 4, and a projection 7*b* which serves as an acting point to rotate the lock cam 5 when the cover 1 is opened. This operation lever 7 is usually urged to rotate clockwise by a spring 11. The projection 7*b* of the operation lever 7 is designed to abut against and press a lower peripheral surface 5*e* of the pressing portion 5*b* of the lock cam 5 at the time of opening operation of the cover 1, which will be described later.

As shown in FIG. 1, elastic members 12 are attached on the inner surface of the cover 1, and each elastic member 12 is formed with a plurality of elastic convex portions 12*a*. A mechanism chassis 13 is provided inside of the body 2 covered with the cover 1, so that a tape cassette will be received between the mechanism chassis 13 and the cover 1.

FIG. 3 is a perspective view of the whole cassette tape recorder in which a tape cassette T is received, as indicated by dashed lines, with the cover 1 in a closed state. The tape cassette T is received between the mechanism chassis 13 inside of the body 2 and the cover 1. FIG. 1 is a diagram viewed from the free-end side (the upper side) of FIG. 3. A magnetic head, pinch rollers and so forth (to be described below) which will be inserted into a front opening of the tape cassette T are provided inside of the body 2 on the lower side of FIG. 3. Also, the cover 1 is designed to rotate about the lower side portion in FIG. 3 as an axis, and opened in a direction indicated by the arrow A.

Figure 4:
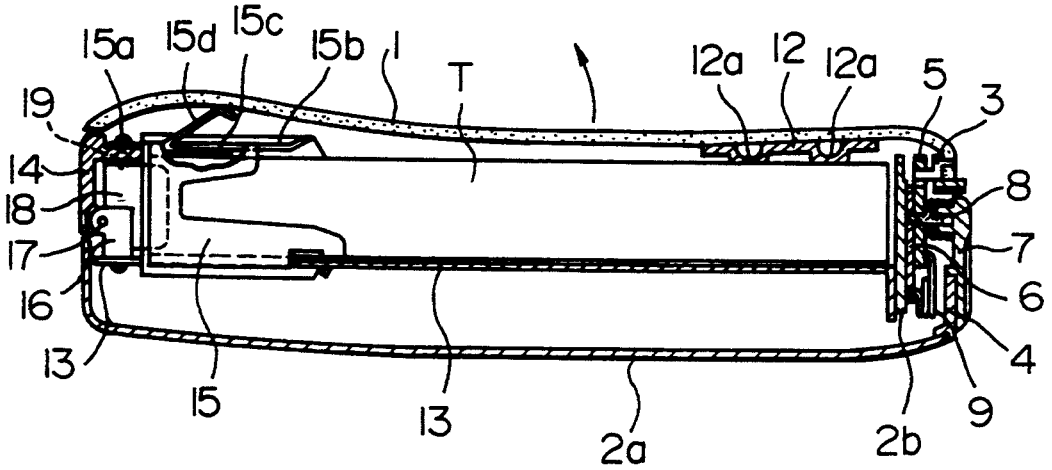
FIG. 4 is a cross-sectional view showing the cover-closed state of the cassette tape recorder in FIG. 3.
Figure 5:
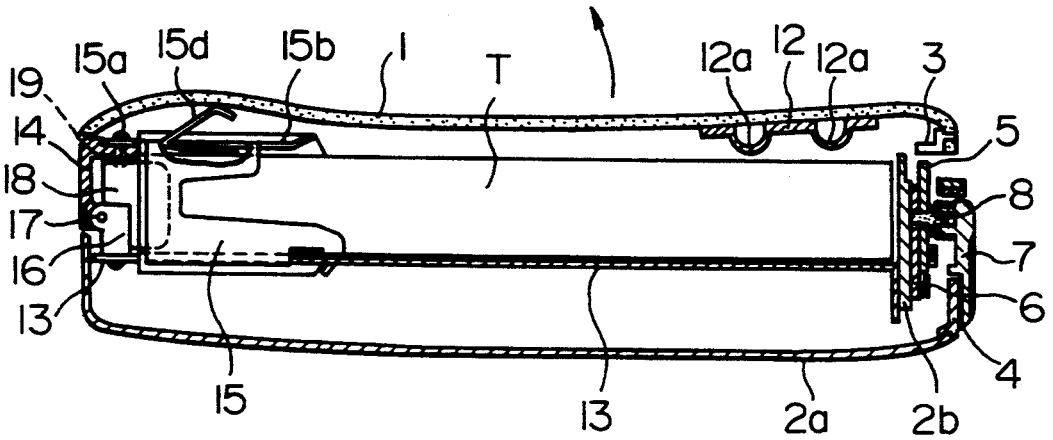
FIG. 5 is a cross-sectional view showing the cover-opened state of the cassette tape recorder in FIG. 3.

Next, descriptions will be given with reference to FIGS. 4 and 5 showing side cross-sections of the cassette tape recorder in which the tape cassette T is received. FIG. 4 is a cross-sectional view showing the cover-closed state, and FIG. 5 is a cross-sectional view showing the cover-opened state in which the lock cam 5 is released from engagement. These figures show, in cross section, a central portion of the cover 1 on the free-end side thereof, and a cassette holder portion of the cover 1 on the rotational-axis side thereof.

As shown in FIGS. 4 and 5, a cassette holder 15 is provided on a holder chassis 14 which is attached to a bearing member 16 rotatably about a shaft 17, the bearing member 16 being provided on the mechanism chassis 13. Head block parts such as a head 18, pinch rollers (not shown) and so forth are mounted on the holder chassis 14. The cassette holder 15 is fastened on the holder chassis 14 by screw-fasteners 15*a* so as to hold both sides of the tape cassette T. A leaf spring 15*c* to abut against and press the top surface of the tape cassette T inserted in the cassette holder 15 and a leaf spring 15*d* to abut against and press the inner surface of the cover 1 are provided on an upper plate portion 15*b* of the cassette holder 15. In this case, an urging force produced by elasticity of the leaf spring 15*d* causes the cover 1 to be rotated by a predetermined angle about a shaft 19 provided on the holder chassis 14. This rotation is within a range from the cover-closed state shown in FIG. 4 to the cover-opened state, i.e., a pop-up state, shown in FIG. 5. From the pop-up state of FIG. 5, the cover 1 can be further rotated about the shaft 17 and opened/closed freely with respect to the body 2. When the cover 1 is opened at such an angle that the tape cassette T will not interfere with mechanism components, e.g., a capstan (not shown) and so forth, the tape cassette T is attached to and detached from the cassette holder 15.

Figure 6:
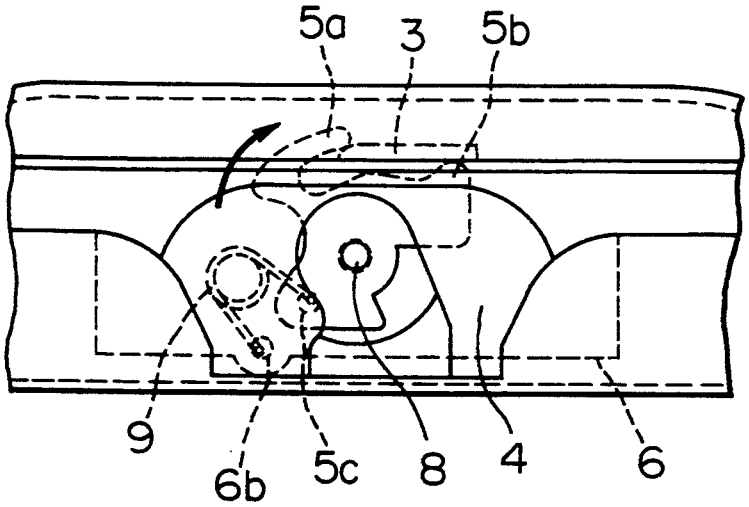
FIG. 6 is a diagram for explaining an important portion of the cassette tape recorder in FIG. 3 in the course of the cover closing operation.

With the cover opening/closing device of the above-described structure according to the invention, the operation will now be described. First, in the cover-opened state shown in FIGS. 1 and 5, i.e., in a first urged state in which the lock cam 5 is urged counterclockwise by the toggle spring 9, the cover 1 is closed against the urging force, and then, the engaging piece 3 of the cover 1 abuts against the pressing portion 5b of the lock cam 5. When the cover 1 is further closed, it will be in a condition shown in FIG. 6. In the condition of FIG. 6, the engaging claw 5a is engaged with an end portion of the engaging piece 3, and the spring-force application portion 5c of the lock cam 5 is located on the line connecting the axis of the rotational shaft 8 and the spring-end fixed portion 6b, and at the located position of the spring-force application portion 5c the toggle spring 9 is in a neutral condition. Consequently, if the cover 1 is pressed at all in the cover closing direction from the condition shown in FIG. 6, the lock cam 5 is rotated in a direction indicated by the arrow in FIG. 6 by the urging force of the toggle spring 9, and brought into a closed state of the cover 1 shown in FIG. 7. In the closed state of the cover 1 of FIG. 7, i.e., in a stable state as a second urged state in which the lock cam 5 is urged clockwise by the toggle spring 9, the engaging claw 5a of the lock cam 5 constantly presses and urges the engaging piece 3 of the cover 1 in the cover closing direction.

Figure 7:
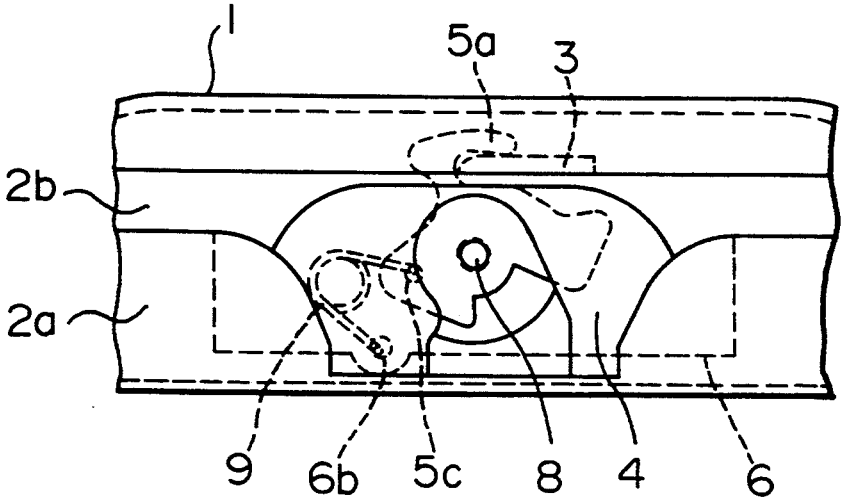
FIG. 7 is a diagram for explaining the same important portion as shown in FIG. 6 when the cover closing operation is completed.
Figure 8:
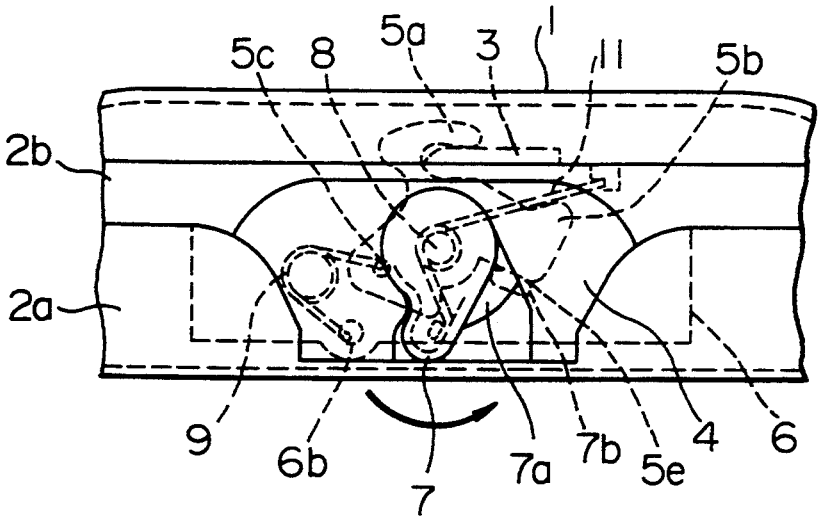
FIG. 8 is a diagram for explaining the same important portion as shown in FIG. 6 when the cover opening operation is started.
Figure 9:
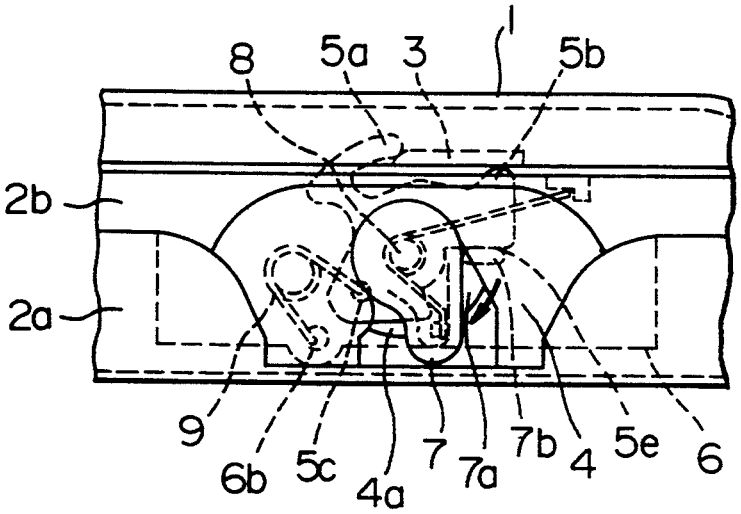
FIG. 9 is a diagram for explaining the same important portion as shown in FIG. 6 in the course of the cover opening operation.

Next, the operation for opening the cover 1 in the closed state will be described. Although the above-described cover-closed state is shown in FIGS. 3, 4 and 7, the following description will be given with reference to a cover-closed state shown in FIG. 8 for convenience's sake. FIG. 8 illustrates the second urged state by substantially the same toggle spring 9 as shown in FIG. 7. In this state, the operation lever 7 is urged clockwise about the rotational shaft 8 by the spring 11, and one of the outer peripheral surfaces thereof abuts against the inner wall of the center opening 4a, with the projection 7b abutting against or being close to the peripheral surface 5e. In the state shown in FIG. 8, in order to open the cover, the operation lever 7 is rotated about the rotational shaft 8 in the counterclockwise direction indicated by the arrow, and then, the projection 7b presses the peripheral surface 5e of the lock cam 5 upwardly, thereby rotating the lock cam 5 counterclockwise against the clockwise urging force of the lock cam 5 by the toggle spring 9. When the lock cam 5 is rotated and brought into a state shown in FIG. 9, the spring-force application portion 5c is located on the line connecting the axis of the rotational shaft 8 and the spring-end fixed portion 6b, and the toggle spring 9 is in the neutral condition at the located position of the spring-force application portion 5c. If the operation lever 7 is rotated counterclockwise at all from the condition shown in FIG. 9, the lock cam 5 is forcibly rotated counterclockwise by the urging force of the toggle spring 9, so that the engaging claw 5a will be released from the engagement with the engaging piece 3, and that the pressing portion 5b will press the engaging piece 3 upwardly. Thus, the lock cam 5 will be in the first urged state by the toggle spring 9, as shown in FIG. 1.

The operation lever 7 is constantly urged to rotate clockwise by the spring 11. When the user releases his finger from the operation lever 7 after the cover opening operation proceeds to the state shown in FIG. 9, the operation lever 7 is returned to the position on which the operation lever 7 is located when the cover is closed, owing to a resilient force of the coil spring 11 which has been compressed by operating the operation lever 7.

Since the urging force of the toggle spring 9 in the second urged state in the closed condition of the cover 1 is constantly exerted even after the cover is closed, as described above, the closed condition between the cover 1 and the body 2 is held closely and stably. Moreover, in the case where the invention is applied to a cassette tape recorder, as in this embodiment, a plurality of elastic convex portions 12a of the elastic members 12 provided on the inner surface of the cassette envelope corresponding to the cover 1 press a rear portion of the received tape cassette T against the mechanism chassis 13 in the cover-closed state, as shown in FIG. 4, so that the tape cassette T can be received stably.

Figure 10:
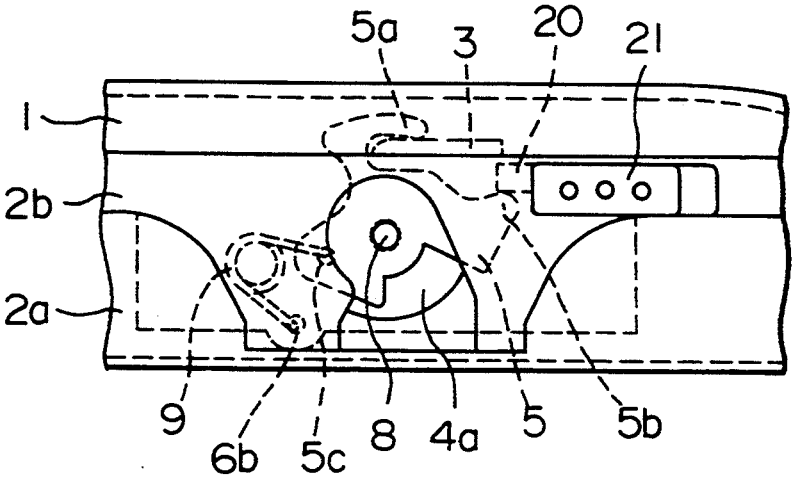
FIG. 10 is a diagram showing the structure of a mechanism for preventing a cover from opening in another embodiment of the invention.
Figure 11:
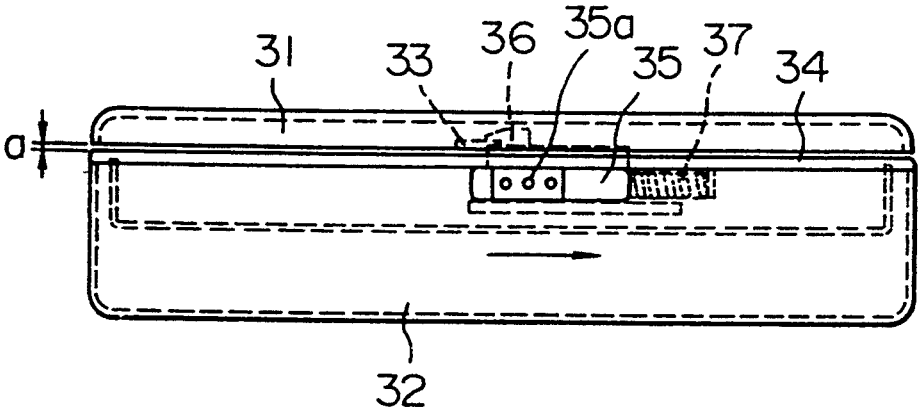
FIG. 11 PRIOR ART
FIG. 11 is a diagram showing the structure of a cover opening/closing device in a conventional cassette tape recorder in the cover-closed state.
Figure 12:
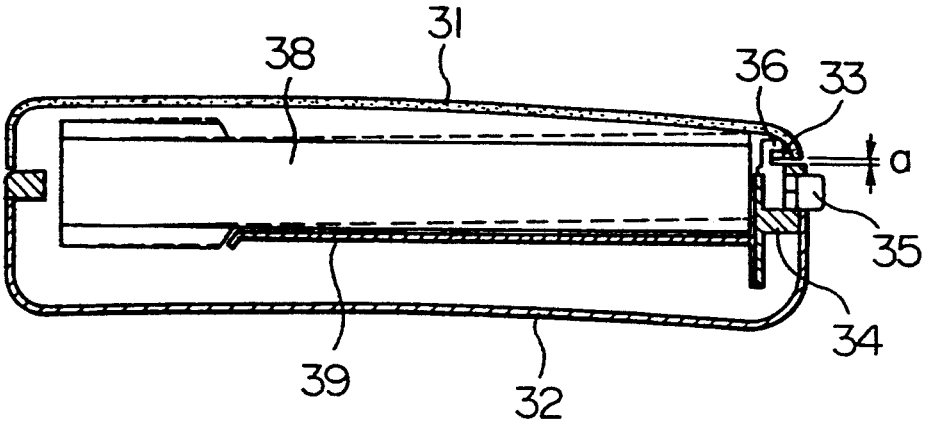
FIG. 12 PRIOR ART
FIG. 12 is a cross-sectional view of the conventional cassette tape recorder in FIG. 11.

FIG. 10 shows another embodiment in which the lock condition in the closed state of the cover 1 is maintained irrespective of rotation of the operation lever 7. More specifically, a prevention lever 20 for preventing the look cam 5 from rotating is provided opposite to the pressing portion 5b of the lock cam 5 in the cover-closed state, and an operation lug 21 for operating this prevention lever 20 is attached on the surface of the intermediate cabinet 2b. With such a structure, as shown in FIG. 10, the lock cam 5 is prevented from rotating by advancing the prevention lever 20 when the cover is closed. When the cover is opened, the prevention lever 20 is slid and retreated to release the lock cam 5 from the rotation prevented condition, thus enabling the cover opening operation.

As described heretofore, the present invention provides a cover opening/closing device for opening/closing a cover by rotating it about a rotational shaft provided in a main body. This device comprises a lock cam rotatably supported on a chassis the constitutes the main body, which lock cam including an engaging claw to be engaged with an engaging piece provided on the cover, an operation lever which can rotate the lock cam, and a toggle spring for urging the lock cam to rotate into two urged states, i.e., a first urged state in which the engaging claw of the lock cam is engaged with the engaging piece and a second urged state in which it is released from the engagement, the operation lever being designed to rotate the lock cam in the engaged condition at least to such a position that the lock cam can be released from the engagement with the engaging piece of the cover. Therefore, when the cover is closed, the cover-closed state is maintained by the urging force of the toggle spring, and even in the cover-closed state, the urging force is constantly exerted in such a manner that the cover is attracted to the main body, thereby preventing backlash between the cover and the main body after the cover is closed, and improving the quality of the product. Moreover, in the case of a cassette tape recorder, even if a cassette tape varies in thickness, the elastic members provided on the inner surface of the cover press the received tape cassette against the mechanism inside of the main body and maintain it at a predetermined position, thus enabling the cassette tape recorder to perform in the intended manner. Furthermore, the mechanism for preventing operational errors can be installed easily. Thus, the cover opening/closing device of the invention has such many advantages and is remarkably excellent in practical use.

What is claimed is:

1. A cover opening/closing device for opening/closing a cover which is rotatably attached by a first rotational shaft to a main body and which has an engaging piece on an open end side, said cover opening/closing device comprising:

a lock cam adapted to be rotatably supported on the main body by a second rotational shaft, said lock cam including (i) an engaging claw for engaging with said engaging piece and (ii) a spring-force application portion;

an operation lever for rotating said lock cam; and a toggle spring connected to said spring-force application portion and supplying an urging force to said lock cam in one of first and second directions in accordance with a position of said spring-force application portion with respect to an axis of said second rotational shaft;

wherein, when said cover is closed, said engaging claw is in an engaged condition in which said engaging claw is engaged with said engaging piece to hold said cover closed, and said toggle spring supplies said urging force in said first direction to urge said engaging claw into said engaged condition;

wherein, when said operation lever is actuated to open said cover, said operation lever rotates said lock cam from the engaged condition at least to a non-engagement condition in which the engaging claw is not engaged with the engaging piece of the cover; and wherein, when said lock cam is in said non-enagagement condition, said toggle spring supplies said urging force in said second direction to urge said lock cam into said non-engagement condition.

2. A cover opening/closing device according to claim 1, wherein said lock cam further includes a pressing portion for projecting toward the engaging piece of the cover when the lock cam is in the non-engaged condition, so that said lock cam is rotated by the engaging piece of the cover when the pressing portion is pressed by the engaging piece of the cover during a cover closing operation, and so that the toggle spring urges said lock cam in the first direction when the engaging piece rotates the lock cam by a predetermined angle, to thereby engage the engaging claw with the engaging piece of the cover and to bring said lock cam into the engaged condition.

3. A cover opening/closing device according to claim 2, wherein said operation lever comprises means for abutting against a predetermined position of said lock cam so as to rotate said lock cam substantially only at a time of a cover opening operation.

4. A cover opening/closing device according to claim 2, further comprising prevention means for preventing the lock cam from comprising prevention means for preventing the lock cam from rotating, said prevention means being adapted to be provided on the main body in a vicinity of the lock cam, so that the cover will not open when the operation lever is accidentally touched in a cover-closed state.

5. A cover opening/closing device according to claim 1, wherein said operation lever comprises means for abutting against a predetermined position of said lock cam so as to rotate said lock cam substantially only at a time of a cover opening operation.

6. A cover opening/closing device according to claim 1, wherein said cover further comprises elastic members, each of said elastic members having a plurality of elastic convex portions, said elastic members being adapted to be attached on an inner surface of the cover, so as to press an article received between said cover and the main body into a predetermined position.

7. A cover opening/closing device according to claim 6, further comprising prevention means for preventing the lock cam from rotating, said prevention means being adapted to be provided on the main body in a vicinity of the lock cam, so that the cover will not open when the operation lever is accidentally touched in a cover-closed state.

8. A cover opening/closing device according to claim 1, further comprising prevention means for preventing the lock cam from rotating, said prevention means being adapted to be provided on the main body in a vicinity of the lock cam, so that the cover will not open when the operation lever is accidentally touched in a cover-closed state.

9. A cover opening/closing device according to claim 1, wherein said main body comprises a chassis, and wherein said lock cam is adapted to be rotatably supported on said chassis.

10. A cover opening/closing device according to claim 1, further comprising a lock cam support plate adapted to be attached to said main body and to said second rotational shaft, said lock cam being adapted to be rotatably supported on said main body by said second rotational shaft and said lock cam support plate.

11. A cover opening/closing device according to claim 10, wherein said toggle spring is connected to a spring-end fixed portion of said lock cam support plate.

12. A cover opening/closing device according to claim 11, wherein said toggle spring supplies said urging force in said first direction when said spring-force application portion is on a first side of a line connecting said axis of said second rotational shaft with said spring-end fixed portion, and wherein said toggle spring supplies said urging force in said second direction when said spring-force application portion is on a second side of said line.

* * * * *